US006467134B1

(12) United States Patent
Stroud

(10) Patent No.: US 6,467,134 B1
(45) Date of Patent: Oct. 22, 2002

(54) FASTENER FOR STRAP

(76) Inventor: Ronald E. Stroud, 441 Mary Lou La., Moncks Corner, SC (US) 29461

( * ) Notice: Subject to any disclaimer, the term of this patent is extended or adjusted under 35 U.S.C. 154(b) by 0 days.

(21) Appl. No.: 09/887,390

(22) Filed: Jun. 22, 2001

(51) Int. Cl.[7] ..... A44B 11/25

(52) U.S. Cl. ..... 24/163 R; 24/265 WS; 24/168; 24/265 BC; 224/258

(58) Field of Search ..... 24/713, 712.1, 24/712.2, 163 R, 265 WS, 265 BC, 265 EC, 163 K, 197, 168, 307, 316; 2/321, 322; 36/50.1; 224/257, 258

(56) References Cited

U.S. PATENT DOCUMENTS

| | | | | | |
|---|---|---|---|---|---|
| 68,341 | A | * | 9/1867 | Bedford | 24/265 BC |
| 186,569 | A | * | 1/1877 | Huerta | 24/168 |
| 187,888 | A | * | 2/1877 | Neff | 24/265 BC |
| 301,520 | A | | 7/1884 | Redding | |
| 1,145,797 | A | | 7/1915 | Roach et al. | |
| 2,257,700 | A | | 9/1941 | Meehan | |
| 2,745,157 | A | | 5/1956 | Bomerscheim | |
| 2,748,436 | A | | 6/1956 | Hoffman | |
| 2,943,332 | A | * | 7/1960 | Meeker | 2/321 |
| 3,883,928 | A | | 5/1975 | Blake | |
| 3,924,304 | A | * | 12/1975 | Grandmont | 24/163 K |
| 4,318,207 | A | * | 3/1982 | Stroud | 24/163 K |
| 4,502,188 | A | | 3/1985 | Kohli | |
| 4,733,440 | A | | 3/1988 | Ogawa | |
| 4,787,124 | A | | 11/1988 | Pozzobon et al. | |
| 4,944,438 | A | * | 7/1990 | Gallagher | 224/624 |
| 5,046,197 | A | * | 9/1991 | Chernuchin et al. | 2/322 |
| 5,152,038 | A | | 10/1992 | Schoch | |
| 5,282,297 | A | | 2/1994 | Angus | |
| 5,410,780 | A | | 5/1995 | Silagy | |
| 5,669,116 | A | | 9/1997 | Jungkind | |
| 5,735,023 | A | | 4/1998 | Smith | |
| 6,141,835 | A | | 11/2000 | Wilson | |
| 6,357,093 | B1 | * | 3/2002 | Takahashi | 24/712 |

* cited by examiner

*Primary Examiner*—Robert J. Sandy
(74) *Attorney, Agent, or Firm*—Harleston Law Firm, LLC; Kathleen M. Harleston

(57) ABSTRACT

A reusable fastener for a strap of a carry bag, dog collar, shoe, necklace, watch strap, belt, or the like includes a plate member having a threaded opening, a generally flat retainer member attached to the rear of the plate member, and a connector having an enlarged head and a threaded post portion. A free end of the strap passes through the retainer member. The threaded opening receives the connector post portion. The remote end of the threaded post member is engageable with the strap to hold the strap in place against an abutment portion of the retainer member without damaging the strap.

17 Claims, 5 Drawing Sheets

FASTENER FOR STRAP

BACKGROUND OF THE INVENTION

1. Technical Field

The present invention is a fastener for a strap of a carry bag, piece of luggage, shoe, belt, watch strap, dog collar, necklace, or the like, more particularly, a strap fastener that does not require holes in an end of the strap.

2. Background Information

Little girls often have a difficult time contending with inserting the pin in a shoe buckle into the appropriate tiny hole in a shoe strap. Oftentimes, a parent will find it necessary to punch an extra hole in a daughter's shoe straps so that the shoes will accommodate her narrow feet, for example. A parent or caregiver may also find himself attempting to repair a hole that has ripped through the shoe strap. There need be no concern over the placement and number of holes in the shoe straps of the present invention, since holes in the straps are not required. With the fastener of the present invention, a girl need only pass the strap over her instep and through the retainer member of the fastener, then grasp a nut and twist it to fasten the strap. Shoes with fasteners according to the present invention will accommodate a girl with a narrow or small foot, a wide or large foot, or one foot larger than the other.

The same is true of the other embodiments of the present invention. This fastener can be used as part of a belt that can accommodate an expanding or shrinking waist without concern over the location and number of holes in the belt. It can be easier to use than, and provides an alternative to, a conventional belt buckle. The present fasteners provide an almost infinite number of settings.

A purse with a strap fastener according to this invention can be carried as a shoulder bag, or as a handbag, as desired by the user. The length of the purse strap can quickly and easily be shortened or lengthened using the present fastener. The present fastener with a strap or scarf can also be employed in a crisscross necklace that can convert to a ladies waist or hip belt.

Finally, a collar for a dog or other pet having a fastener according to the present invention can grow with the dog, since fit is not dependent on whether the holes on a conventional pet collar are positioned correctly for that particular pet. A collar having a fastener according to the present invention can fit around a puppy's neck, as well as the neck of an adult dog, depending only on the length of the collar strap. The pet owner need not stand in the store at the dog collar display attempting to recall how big his or her pet's neck is. A dog, or pet, collar having the present fastener need not be pierced, since the present fastener does not require that the strap have holes. A collar which includes the fastener of the present invention can be custom-fit around the neck of the user's pet. These and other embodiments including the versatile fastener of the present invention are possible.

BRIEF SUMMARY OF THE INVENTION

The present invention is a fastener for a strap having a looped end and an end opposite to the looped end. The fastener includes:

(a) a plate member having a front face and a rear face, and comprising a central threaded opening between the front and rear faces;

(b) a retainer member fixedly attached to the plate member and including an abutment portion disposed in spaced relation to the rear face of the plate member behind the threaded opening, wherein the free end portion of the strap is received between the abutment portion and the plate member;

(c) attachment means for attaching the plate member to the looped end of the strap; and (d) a connector having a threaded post portion received by the correspondingly threaded opening of the plate member in adjustable relation thereto, and having a remote end engageable with the free end portion of the strap to clampingly engage the strap against the abutment portion, the connector including an enlarged, integrally formed head. Also included is a necklace which can double as a belt. The necklace/belt includes the fastener and a strap.

BRIEF DESCRIPTION OF THE SEVERAL VIEWS OF THE DRAWINGS

A more complete understanding of the invention and its advantages will be apparent from the following detailed description taken in conjunction with the accompanying drawings, wherein examples of the invention are shown, and wherein.

DETAILED DESCRIPTION OF THE INVENTION

Figure 1:
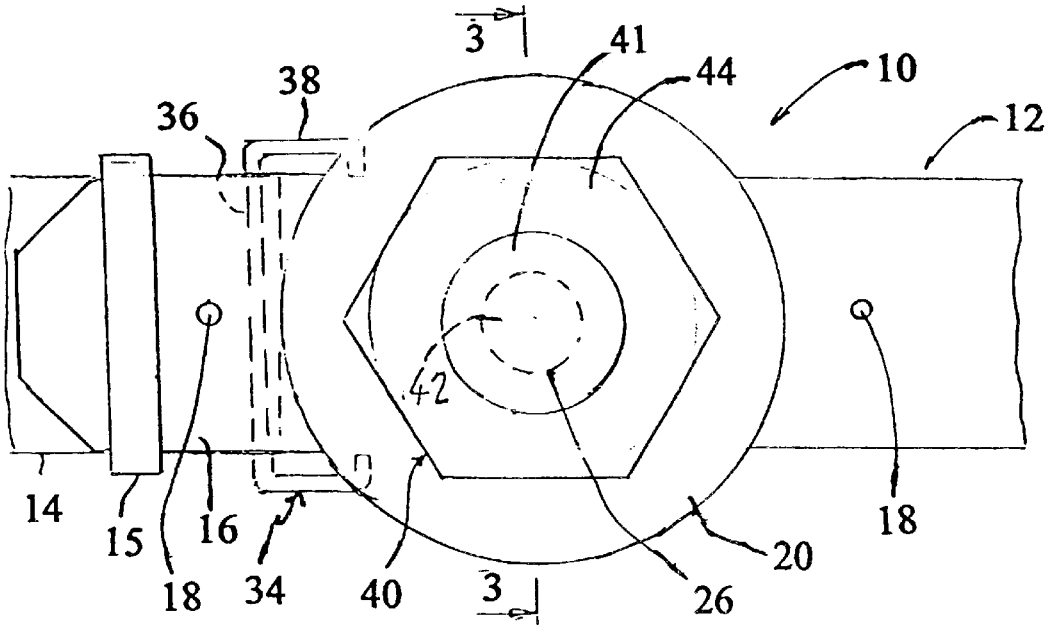
FIG. 1 is a front elevational view of a belt fastener according to the present invention, shown in a connected position.

In the following description, like reference characters designate like or corresponding parts throughout the several views. Also, in the following description, it is to be understood that such terms as "front," "rear," "within," and the like are words of convenience and are not to be construed as limiting terms. Referring in more detail to the drawings, the invention will now be described.

Turning first to FIG. 1, a preferred embodiment of a strap fastener, generally indicated by 10, forms part of a belt 11. A strap 12 of the belt has a looped end 14 and an opposite, free end 16. The free end 16 of the strap includes a plurality of holes 18, constituting pierced portions of the belt, and the looped end 14 of the strap is connected to itself by snap fasteners 19 or the like.

Figure 2:
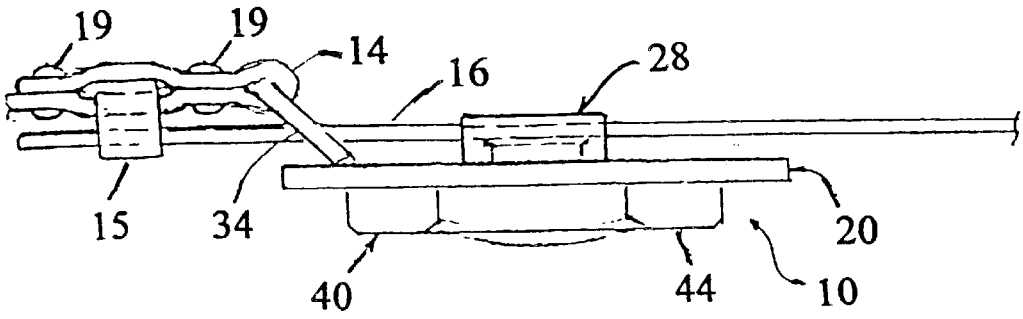
FIG. 2 is a top plan view of the belt fastener of FIG. 1.
Figure 3:
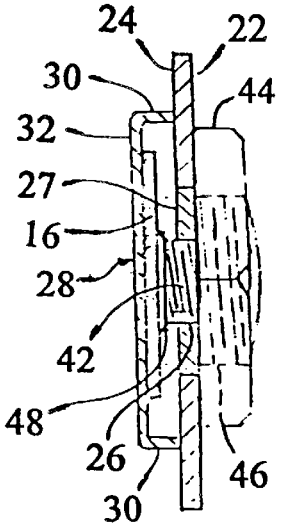
FIG. 3 is a cross-sectional view taken on line 3—3 of FIG. 1.

As shown in FIGS. 1 through 3, the belt fastener 10 comprises a plate member 20, which is preferably a washer. The plate member 20 has a front face 22, a rear face 24, and a threaded opening 26 extending between the front and rear faces (see FIG. 3). In the embodiment shown in FIG. 3, the plate member 20 has a disc filler 27 brazed or otherwise attached within an existing unthreaded opening to permit a relatively small threaded opening 26 to be formed. Any suitable method of forming the threading in the opening 26 may be employed, though.

The fastener of the present invention is for removably fastening one end of a strap 12 to the other, as for a belt, or for removably fastening the end of one strap to the end of another strap. The strap can be on a carry bag, piece of luggage, shoe, belt, dog collar, or necklace, for example. The strap may be made of a flexible or malleable material such as leather, fabric, plastic, or any other suitable material. The fastener may be made of metal or a durable plastic, for example.

Figure 5:
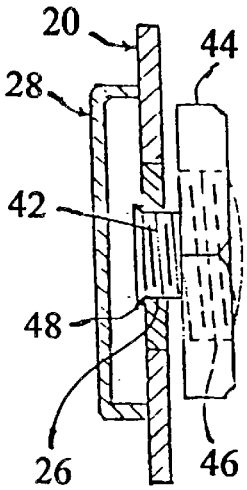
FIG. 5 is a cross-sectional view taken on line 5—5 of FIG. 4.

While FIG. 1 shows the fastener 10 in a connected position, which would occur when a wearer fastened the belt 11 around his or her waist, FIG. 5 shows the belt fastener of FIG. 1 in an unconnected position, which would occur when the wearer unfastened his or her belt 11. Just as FIG. 3 is a cross-section of FIG. 1, FIG. 5 shows a cross-section of FIG. 4. Both cross-sections are taken approximately across the center of the respective fasteners 10.

Referring to FIGS. 1 through 5, a generally rectangular-shaped retainer member 28, including a pair of arm portions 30 and a bight portion is attached to the rear of the plate member 20. The bight portion provides an abutment portion 32 and is fixedly attached to the plate member 20, as by brazing the arm portions 30 to the rear face 24 of the plate member 20. The abutment portion is disposed directly behind the threaded opening 26 in spaced relation to the plate member rear face 24. The opposite, free end 16 of the belt 10 is received between the abutment portion 32 and the plate member 20. The distance between the arm portions, or the length of the retainer member 28, is just sufficient to accommodate the width of the strap intended for insertion therethrough. The retainer member 28 is preferably no wider than the diameter of the plate member 20, so that it is not seen when the belt is viewed from the front on a wearer.

Figure 4:
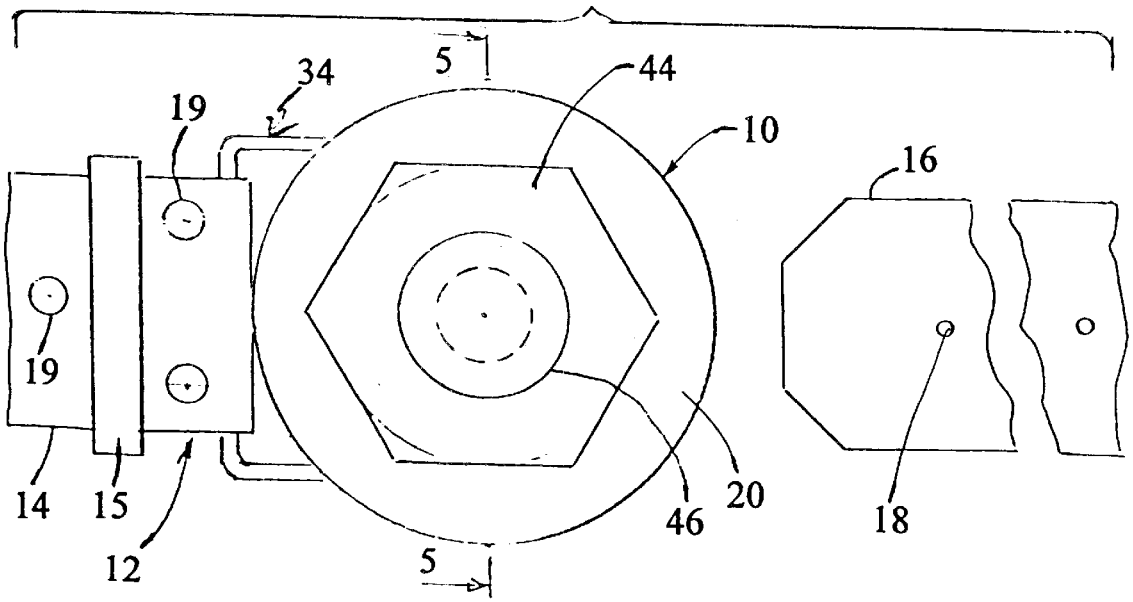
FIG. 4 is a front elevational view of the belt fastener of FIG. 1, shown in an unconnected position.

As shown in FIGS. 1, 2 and 4, a loop member 34 is preferably attached to the plate member 20. The loop member includes a first loop portion 36, disposed in spaced relation behind the plate member rear face 24 and receiving the strap looped end 14, and a pair of arm portions 38 attached to the plate member rear face 24, as by brazing. (The plate member thus forms a portion of the loop.) Because of this arrangement, the loop member 34 provides means for attaching the plate member 20 to the looped end 14 and cooperates with the plate member to define an opening receiving the strap opposite end 16.

Continuing with FIGS. 1–5, the fastener 10 also includes a connector 40 made up of a threaded post portion 42 and an enlarged head portion 41. In the embodiment shown, the enlarged head portion 41 is integrated with a nut 44 receiving a threaded bolt shank member 46. A lock nut can be used to reduce the thickness of the head. The shank member 46 received by the nut 44 is brazed or otherwise fixedly attached to the nut, which in effect creates a bolt member. In the embodiment shown, the post portion 42 is reduced in diameter relative to the shank member 46 and is attached to the shank member as by brazing (see FIGS. 3 and 5). This arrangement permits a finer thread to be used in the opening 26 and allows a relatively thin plate member 20 to be used. Also, a very small fastener can be manufactured according to this invention. The small fastener is effective for use despite its small size.

As will be understood, the threaded post portion 42 is received within the threaded opening 26 in adjustable relation and, as shown in FIG. 3, the post portion 42 includes a remote end 48 clampingly attaching the free end 16 to the abutment portion 32 of the retainer member 28. As shown in FIG. 5, the connector post portion 42 can readily be backed-off to release the free strap end 16. Since the fastener 10 is shown unconnected in FIG. 5, no strap is present in the retainer member 28. In order to preclude complete removal of the connector 40, a stop means is provided by slightly enlarging the remote end 48 as by spreading (see edge of remote end in FIG. 5) or providing a bearing plate. Thus, the connector will not fall out from the opening 26 in the plate member when the fastener is unfastened.

As shown in FIG. 3, engagement between the underside of the nut 44 and the plate member front face 22 provides a limit to the clamping engagement of the post portion 42 with the free end 16. The post portion remote end 48 can be serrated to increase the holding capability of the connector 40. As shown in FIGS. 1 and 2, the free end 16 is received through the loop member 34 and belt loop 15 to complete the connection.

Figure 7:
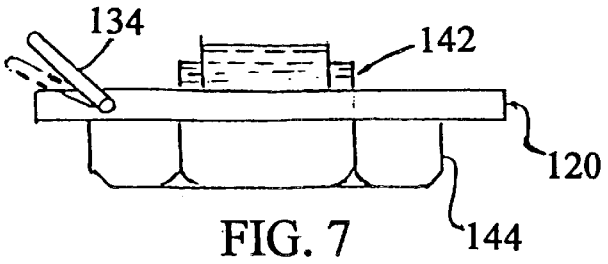
FIG. 7 is a top plan view of the fastener according to FIG. 6.
Figure 6:
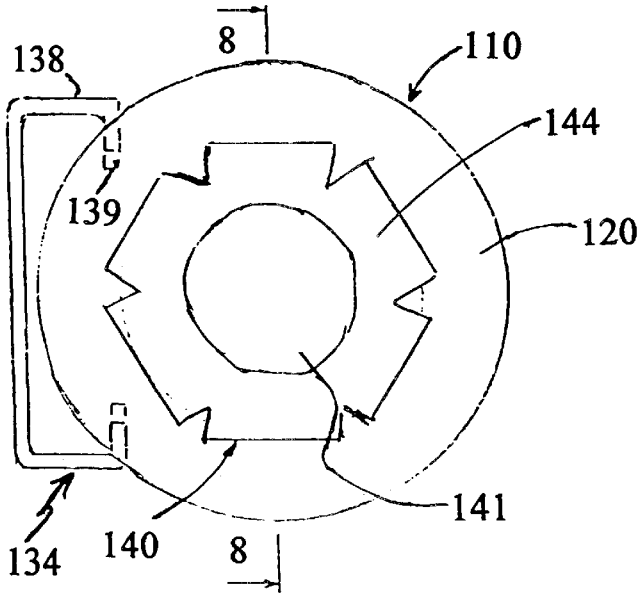
FIG. 6 is a front elevational view of an alternate embodiment of a fastener according to the present invention.
Figure 8:
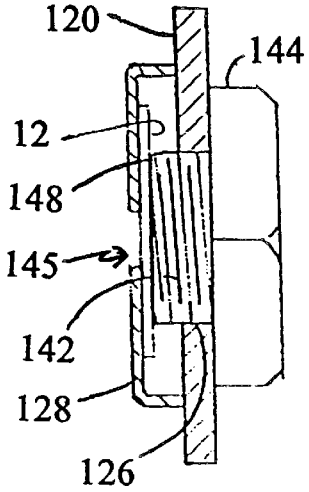
FIG. 8 is a cross-sectional view taken on line 8—8 of FIG. 6.

Referring to FIGS. 6, 7, and 8, an alternate embodiment of a modified fastener 110, without a strap, is shown from the front (FIG. 6) and top (FIG. 7, shown without a retainer member). This fastener 110 is shown in cross-section in FIG. 8 with a strap extending through the retainer member 28. In this embodiment, a thicker plate member 120 is used in conjunction with a larger diameter connector post portion. In this modified fastener, the connector 140 is provided by a bolt having a shank providing the post portion 142 and a nut 144. The plate member 120 can be formed with a suitable threaded opening 126 and the thread of the shank can be formed to suit the opening as described.

In FIG. 6, the nut 144 is shown with an alternate, flower-like shape. The periphery of the nut 144 is preferably shaped so that it is easy for the user to grasp the edges and wind the nut 144 clockwise to connect the fastener 110, or counterclockwise to disconnect the fastener. The nut used herein need not have the traditional six-sided shape of a nut. The shapes and materials of the fasteners and straps can be chosen to be attractive to the intended market.

With the thicker plate member 120, a modified hinge loop 134 can be used as shown in FIG. 7. In the modified hinge loop 134, the arm portions 138 are downwardly formed and received within the plate member openings 139. The retainer member and other aspects of the belt fastener 110 are the same as described above for the belt fastener 10.

Continuing with FIG. 8, the retainer member 128 may optionally have a hole 145 in it directly behind the threaded opening 126, so that when the fastener 110 is connected and the remote end 148 of the threaded post portion 142 presses on the strap 12, some give is provided. The edges of the hole 145 in the retainer member 128 also help to grip the strap 12.

Thus, a belt fastener 10 for a belt 11 having a looped end 14 and a free end 16 opposite to the looped end comprises:

(a) a plate member 20 having a front face 22 and a rear face 24, and a threaded opening 26 between the front and rear faces;

(b) a retainer member 28 fixedly attached to the plate member 20 and including an abutment portion 32 disposed in spaced relation to the rear face 24 of the plate member 20 behind the threaded opening 26;

(c) attachment means 34 for attaching the plate member to the looped end 14 of the belt; and (d) a connector 40 having a threaded post portion 42 received by the correspondingly threaded opening 26 of the plate member 20 in adjustable relation to it. The connector has a remote end 48 engageable with the free end 16 of the belt to hold the belt 11 in place against die abutment portion 32. The remote end 48 is adjustably movable relative to the abutment portion 32. The connector further includes an enlarged, integrally formed bead portion 41. The free end 16 of the belt is received between the abutment portion 32 and the plate member 20. The retainer member 28 preferably further comprises a central hole 145. The connector enlarged head 41 is preferably a nut 44 which threadedly receives the post portion 42.

The belt fasteners described above are all used in substantially the same manner. Once the belt fastener 10 is attached to the looped end 14, the opposite, free end 16 can be slipped through the waist band loops of the user and threaded through the retainer member 28 and the loop member 34. Following this, the connector 40 is screwed into clamped engagement with the free end 16 of the strap 12.

Figure 9:
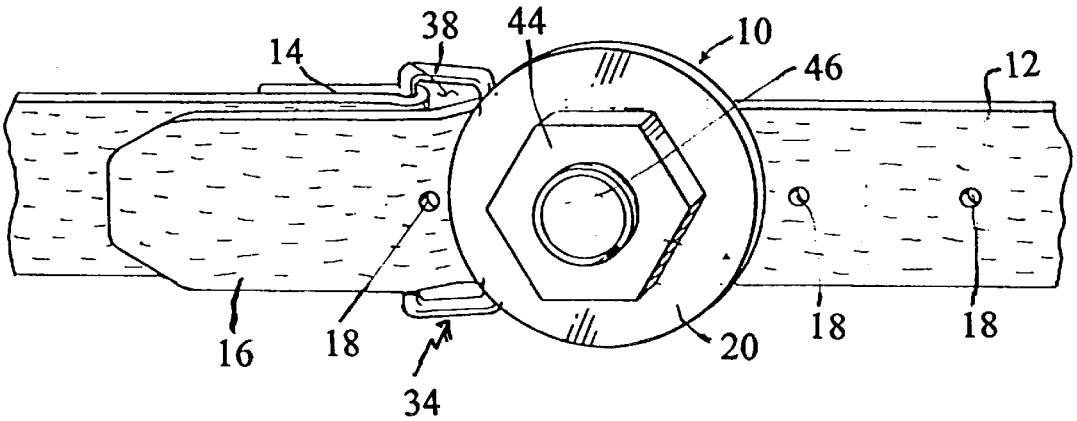
FIG. 9 is a front perspective view of a luggage strap fastener according to the present invention.

Referring to FIG. 9, another alternate embodiment of the present invention is a fastener for a strap which encircles a piece of luggage (not shown), such as a suitcase, or between two portions of a piece of luggage, such as a soccer bag. The second, free end 16 of the strap 12 here is pierced at 18. The looped end 14 of the strap 12 extends through loop member 34, which includes loop arm portions 38.

Figure 10:
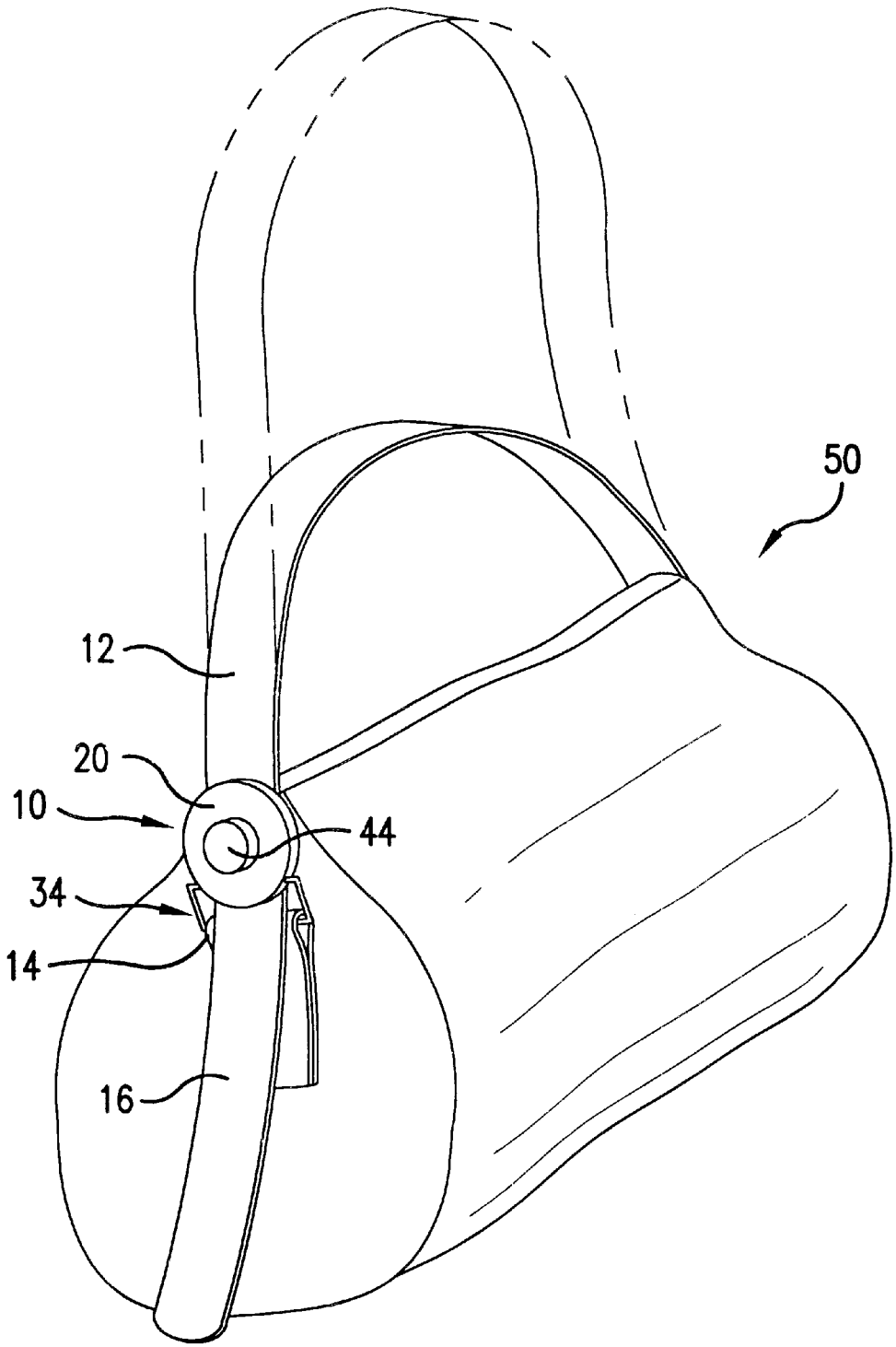
FIG. 10 is a front perspective view of a purse strap fastener according to the present invention.

Referring to FIG. 10, a carry bag 50 with a strap 12 and fastener 10 are illustrated. The length of the strap 12 can quickly and easily be adjusted using the fastener 10. Thus, a purse according to this embodiment can be carried as a shoulder bag, or as a handbag, as desired by the user. The user adjusts the length of the strap 12 by rotating the nut 44 counterclockwise to disconnect the remote end of the post portion from the strap, pulling down on the free end 16 of the strap, and rotating the nut 44 clockwise though the plate member 20 to fasten the post portion again down against the strap. To lengthen the strap, the user would pull up on the center portion of the strap above the fastener before refastening the fastener. An elongated strap is shown in outline in FIG. 10. Thus, for the handbag fastener embodiment, the handbag strap can be adjusted between a first strap position for carrying the purse in one hand, and a second, shoulder strap position for carrying the purse over a shoulder.

Many currently available shoulder bags employ a buckle part way along the shoulder strap. The user shortens the strap by unbuckling the strap and tightening it. A conventional mid-strap buckle, though, tends to come undone, which causes the purse to fall to the ground from the user's shoulder. If the purse is open, the contents spill out on the ground when this happens. Also, mid-strap buckles tend to catch on, for example, automobile consoles or stick shifts when the user is exiting her car, and other projections, such as railings. When the buckle catches, the user's forward motion is halted as she is pulled backward by the purse. The buckle may then come undone, which causes the purse to fall. The buckles can be clumsy and uncomfortable to the user. Employing a fastener of the present invention avoids these difficulties.

In FIG. 10, the fastener 10 is attached to the bag 50 by the looped end 14 of a strap portion affixed to the bag. The looped end 14 extends through the loop member 34 of the fastener. As described herein, the free end 16 of the strap 12 passes through a retainer member at the rear of the fastener 10. The threaded post portion 42 affixed to the bottom of the nut 44 passes through a correspondingly threaded opening in the plate member 20. When the fastener 10 is in the connected position, the remote end 48 of the post portion pushes down on the strap 12 against the retainer member 28. The fastener 10 is sufficient to hold up the weight of the purse. A carry bag 50 preferably has one fastener 10 on the right or left side, though a bag can have more than one fastener 10. These fasteners 10 can also be used on backpacks wherever buckles or other conventional fasteners are presently employed.

Figure 11:
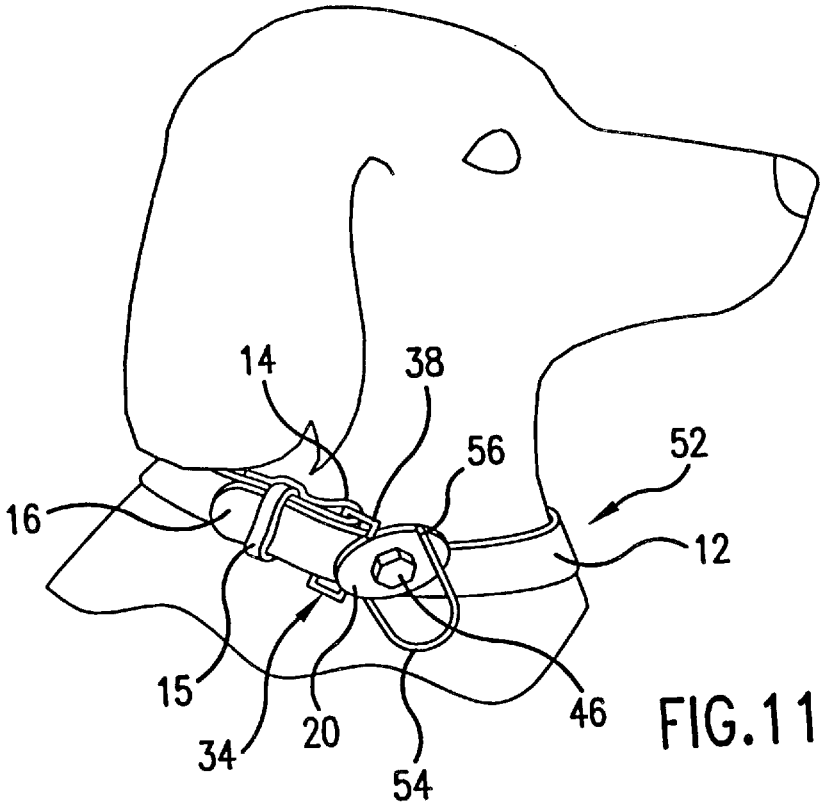
FIG. 11 is a front perspective view of a dog collar fastener according to the present invention.

FIG. 11 illustrates a further embodiment of the invention, a dog collar 52. The collar may also be used for a cat or other pet. The fastener 10 for a dog collar may have a dog tag holder 54 attached to it. The tag holder 54 is preferably U-shaped, with each end 56 of the tag holder being hingedly affixed to the edge of the plate member 20 on opposite sides of the plate member. The dog owner can affix the dog tags and/or a dog leash to the holder. Like the belt, the looped end 14 of the strap 12 is looped through the loop member 34 on the fastener 10. The free end 16 of the strap passes through the retainer member, the loop member 34, and the strap loop 15. The latter is to keep the free end from flapping around.

The free end 16 of the collar 52 need not be pierced, since the fastener 10 does not require that the strap have holes. The collar can be made tight enough to fit the pet's neck. Fit is not dependent on whether the holes on the dog collar are positioned correctly for that particular dog. The collar of the present invention can "grow with the dog". The collar can fit a puppy's neck, as well as the neck of an adult dog, depending only on the length of the strap. The pet owner need not stand in the store at the dog collar display attempting to recall how big his or her pet's neck is. The head of the threaded bolt can be separate from the nut 44, as shown in FIGS. 4 and 6, or it can be integrated with the nut 44, as shown in FIGS. 11 and 12.

The present fastener can also be used in combination with a watch strap. The watch band fastener resembles the one shown on the dog collar of FIG. 11. In use, the fastener 10 falls on the underside of the wrist, and the watch, which is fastened to the strap, falls on the top of the wrist. Oftentimes a conventional watch strap buckle is difficult to fasten around one's own wrist. The watch strap slips around and it is difficult to get the pin of the buckle through the appropriate hole in the end of the strap. The present watch strap embodiment is easy for the wearer to fasten, and the watch strap has no holes or buckles.

Figure 12:
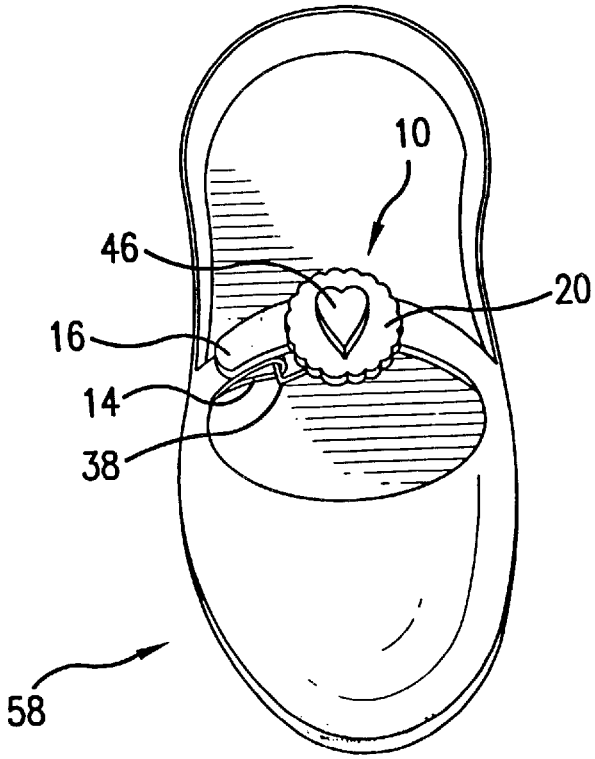
FIG. 12 is a front perspective view of a shoe fastener according to the present invention.

FIG. 12 illustrates a further embodiment of the present invention, a shoe 58. A girl's Mary Jane-style dress shoe is shown. The small fastener 10 is attached to the shoe by the looped strap end 14 passing through the loop member 34 of the fastener 10. The free end 16 of the strap from the opposite side of the shoe passes through the retainer member 28 of the fastener. Here, the nut 44 is in the shape of a heart, and the edge of the plate member 20 is scalloped to give it a pleasing appearance.

Little girls often have a difficult time contending with inserting the pin in a shoe buckle into the appropriate tiny hole in a shoe strap. With the embodiment of FIG. 12, the girl need only pass the strap over her instep and through the retainer member of the fastener, then grasp the heart-shaped nut 44 and twist it to fasten the strap. Oftentimes, a parent will find it necessary to punch an extra hole in a daughter's shoe straps so that the shoes will accommodate her narrow feet, for example. A parent or caregiver may also find himself attempting to repair a hole that has ripped through the shoe strap. There need be no concern over the placement and number of holes in the shoe straps of the present invention, since holes in the straps are not required. Shoes with fasteners according to the present invention will accommodate a girl with a narrow or small foot, a wide or large foot, or one foot larger than the other. The present invention can also be used for fastening sandal straps, or thin straps on high heels.

Figure 13:
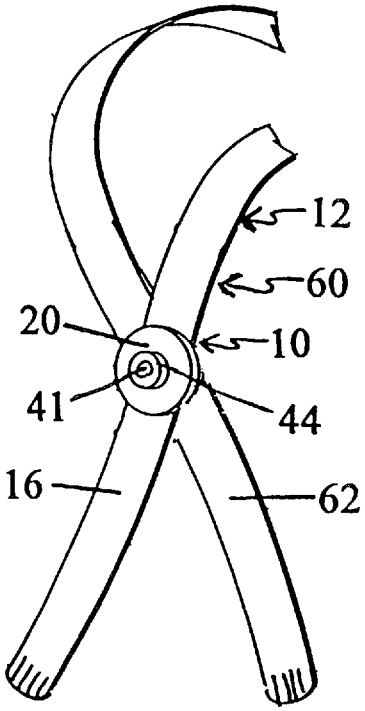
FIG. 13 is a front perspective view of a necklace according to the present invention.

FIG. 13 illustrates a leather necklace 60 having a fastener 10 according to the present invention. To use this embodiment, a user simply places a long leather strap around her neck (or waist or hips), and passes the two free ends of the strap through the retainer plate 28 in the rear of the fastener, with one strap end portion crossed over the other within the retainer plate. She tightens or loosens the strap or scarf to a desired position, slides the fastener up the strap or scarf end portions to the desired position, and adjusts the strap ends over one another so that about a 45 degree angle is formed. She then rotates the nut 44 to clampingly engage the end of the post portion 48 against the strap end portion closest to the remote end. That strap end portion presses down on the strap end portion beneath it, which is compressed against the rear of the retainer member 28. This pressure holds the strap end portions 16, 62 in place until the user unfastens the fastener and removes the necklace. In this manner, the free strap ends cross 16, 62 over one another and are held in place by the fastener. The fastener generally falls at or below the collarbone of the wearer. Fringed ends are shown at the ends of the strap in FIG. 13.

The same necklace shown in FIG. 13 can alternatively be fastened by the wearer lower down on the strap ends and used as a belt at the waist or hip (on a slim woman). In that instance, the free strap ends 16, 62 would be shorter because a woman's waist or hips are larger than her neck. The fastener generally falls against the wearer's right or left two hip protrusion. The center portion of the strap 12 loops around the waist, hips, or neck of the wearer. The fastener can be small in diameter (for a thin strap) or large (for a thicker strap), and its upper surface can be encrusted with crystals or costume jewels for an attractive appearance. The plate member and/or the retainer member 28 need not be round in shape. The shape of either one can be square, rectangular, octagonal, fluted, heart-shaped, etc. The strap could alternatively be a scarf, a sturdy fabric with fringed or tasseled ends, or the like. The fastener 10 could be used on a crisscross neck of a halter top (in which case the fastener would fall at approximately the center of the collar bone of the wearer), or at the back of a shirt.

Thus, a necklace 60 which converts to a ladies belt comprises a fastener 10, and a strap 12, or scarf, having two opposite free end portions. The fastener includes:

(a) a plate member 20 having a front face 22 and a rear face 24, and a central threaded opening 26 between the front and rear faces;

(b) a retainer member 28 fixedly attached to the plate member 20 and including an abutment portion 32 disposed in spaced relation to the rear face of the plate member 20 behind the threaded opening 26; and (c) a connector 40 having a threaded post portion 42 received by the correspondingly threaded opening 26 of the plate member 20 in adjustable relation to the plate member. A remote end 48 of the connector 40 is engageable with the free end portions 16, 62 of the strap 12 or scarf to hold them in place against the abutment portion 32. The connector 40 also includes an enlarged, integrally formed bead 41. Both of the free end portions 16, 62 of the strap or scarf are received between the abutment portion 32 and the plate member 20, and the free end portions are crossed over one another within the retainer member 28. The connector enlarged head 41 is preferably a nut 44 threadedly receiving the post portion 42. The post portion 42 includes stop means for preventing removal of the connector 40 from the plate member 20. For all of the embodiments of the present invention, the remote end of the post portion, but not the rear face of the plate member, clampingly engage the free end of the strap.

From the foregoing it can be realized that the described device of the present invention may be easily and conveniently utilized as a fastener for a strap of a belt, necklace, shoe, carry bag, luggage, watch strap, or dog collar, for example. It is to be understood that any dimensions given herein are illustrative, and are not meant to be limiting.

While preferred embodiments of the invention have been described using specific terms, this description is for illustrative purposes only. It will be apparent to those of ordinary skill in the art that various modifications, substitutions, omissions, and changes may be made without departing from the spirit or scope of the invention, and that such are intended to be within the scope of the present invention as defined by the following claims. It is intended that the doctrine of equivalents be relied upon to determine the fair scope of these claims in connection with any other person's product which fall outside the literal wording of these claims, but which in reality do not materially depart from this invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A fastener for a strap having a looped end and a free end portion opposite to the looped end, the fastener comprising:

(a) a plate member having a front face and a rear face, and comprising a central threaded opening between tile front and rear faces;

(b) a retainer member fixedly attached to the plate member and including an abutment portion disposed in spaced relation to the rear face of the plate member behind the threaded opening, wherein the free end portion of the strap is received between the abutment portion and the plate member;

(c) attachment means for attaching the plate member to the looped end of die strap; and (d) a connector having a threaded post portion received by the correspondingly threaded opening of the plate member in adjustable relation thereto, and having a remote end engageable with the free end portion of the strap to clampingly engage the strap against the abutment portion, the connector including an enlarged, integrally formed head portion; and wherein the plate member is a circular washer.

2. A fastener according to claim 1, wherein the attachment means for the looped end of the strap comprises a loop member having a first portion disposed behind the rear face of the plate member receiving the looped end of the strap, a second portion attached to the plate member, and an opening between the first portion and the plate member receiving the free end portion of the strap.

3. A fastener according to claim 2, wherein the second portion of the loop is fixedly attached to the plate member.

4. A fastener according to claim 2, wherein the second portion of the loop is hingedly attached to the plate member.

5. A fastener according to claim 2, wherein the connector is provided by a bolt.

6. A fastener according to claim 2, wherein the fastener and strap are provided on a dress shoe or sandal.

7. A fastener according to claim 2, wherein the strap is on a handbag and has a first, hand strap position, and a second, shoulder strap position.

8. A fastener according to claim 2, in combination with a watch strap, the watch strap comprising no holes or buckles.

9. A fastener according to claim 1, wherein the connector enlarged head is a nut threadedly receiving the post portion.

10. A fastener according to claim 1, wherein the remote end is adjustably movable relative to the abutment portion, and the connector post portion comprises stop means adapted to prevent removal of the connector from the plate member.

11. A fastener according to claim 1, wherein the retainer member further comprises retainer arm portions fixedly attached to the rear face of the plate member and a bight portion providing the abutment portion.

12. A fastener according to claim 1, wherein the strap is a dog collar, and the fastener further comprises a dog tag holder.

13. A fastener according to claim 1, wherein the strap is on a carry bag.

14. A belt fastener for a belt having a looped end and a free end opposite to the looped end, the fastener comprising:

(a) a plate member having a front face and a rear face, and a threaded opening between the front and rear faces;

(b) a retainer member fixedly attached to the plate member and comprising an abutment portion disposed in spaced relation to the rear face of the plate member behind the threaded opening, wherein the free end of the belt is received between the abutment portion and the plate member;

(c) attachment means for attaching the plate member to the looped end of the belt; and (d) a connector having a threaded post portion received by the correspondingly threaded opening of the plate member in adjustable relation thereto, and having a remote end engageable with the free end of the belt to hold the belt in place against the abutment portion, the remote end being adjustably movable relative to the abutment portion, the connector further comprising an enlarged, integrally formed head portion; and wherein the connector enlarged head is a nut threadedly receiving the post portion.

15. A fastener according to claim 14, wherein the retainer member further comprises a central hole.

16. A necklace or belt comprising a fastener, and a strap or scarf having two opposite free end portions, the fastener comprising:

(a) a plate member having a front face and a rear face, and comprising a central threaded opening between the front and rear faces;

(b) a retainer member fixedly attached to the plate member and including an abutment portion disposed in spaced relation to the rear face of the plate member behind the threaded opening, wherein both of the free end portions of the strap or scarf are received between the abutment portion and the plate member, the free end portions being crossed over one another within the retainer member; and (c) a connector having a threaded post portion received by the correspondingly threaded opening of the plate member in adjustable relation thereto, and having a remote end engageable with the free end portions to hold them in place against the abutment portion, the connector including an enlarged, integrally formed head portion; and wherein the connector enlarged head is a nut threadedly receiving the post portion.

17. A necklace or belt according to claim 16, wherein the connector post portion comprises stop means adapted for preventing removal of the connector from the plate member.

* * * * *